United States Patent [19]

Simko

[11] 4,213,435

[45] Jul. 22, 1980

[54] AIR/FUEL RATIO REGULATOR

[75] Inventor: Aladar O. Simko, Dearborn Heights, Mich.

[73] Assignee: Ford Motor Company, Dearborn, Mich.

[21] Appl. No.: 937,695

[22] Filed: Aug. 29, 1978

[51] Int. Cl.[3] ..... F02D 1/06; F02M 7/00

[52] U.S. Cl. ..... 123/446; 123/510; 123/568; 123/340 GS

[58] Field of Search ..... 123/140 MP, 140 MC, 123/139 BG, 139 E, 119 A

[56] References Cited

U.S. PATENT DOCUMENTS

| | | | |
|---|---|---|---|
| 2,305,070 | 12/1942 | Butler et al. | 123/140 MC |
| 2,825,321 | 3/1958 | Anders | 123/140 MC |
| 2,901,885 | 9/1959 | Reggio | 123/140 MC |
| 3,020,776 | 2/1962 | May et al. | 123/140 MC |
| 4,009,700 | 3/1977 | Engels et al. | 123/119 A |

FOREIGN PATENT DOCUMENTS

| | | | |
|---|---|---|---|
| 414580 | 8/1946 | Italy | 123/140 MC |
| 538229 | 7/1941 | United Kingdom | 123/140 MC |

*Primary Examiner*—Ira S. Lazarus
*Assistant Examiner*—Magdalen Moy
*Attorney, Agent, or Firm*—Robert E. McCollum; Clifford L. Sadler

[57] ABSTRACT

A air/fuel ratio regulator for control of the movement of a fuel flow control lever on a fuel injection pump. A lever is connected to the pump lever and moved by an aneroid to change the pump fuel flow as a function of engine manifold vacuum changes to maintain a constant air/fuel ratio to the mixture charge. A fuel enrichment lever moves to modify the movement of the fuel control lever to compensate for changes in intake manifold gas temperature as sensed by a coil thermostat, to maintain the constant air/fuel ratio. A fuel enrichment shaft having a piston is connected to the enrichment lever and to a number of spaced, interconnected but relatively movable pistons, and that are adjustable to change the position of the enrichment lever and therefore the air/fuel ratio as a function of exhaust gas recirculation back into the engine, and operating the engine at cruising conditions for an extended period, or operating the engine at idle speed, all with leaner air/fuel ratios. An infinite number of different air/fuel ratios can be established.

7 Claims, 2 Drawing Figures

AIR/FUEL RATIO REGULATOR

Figure 1:
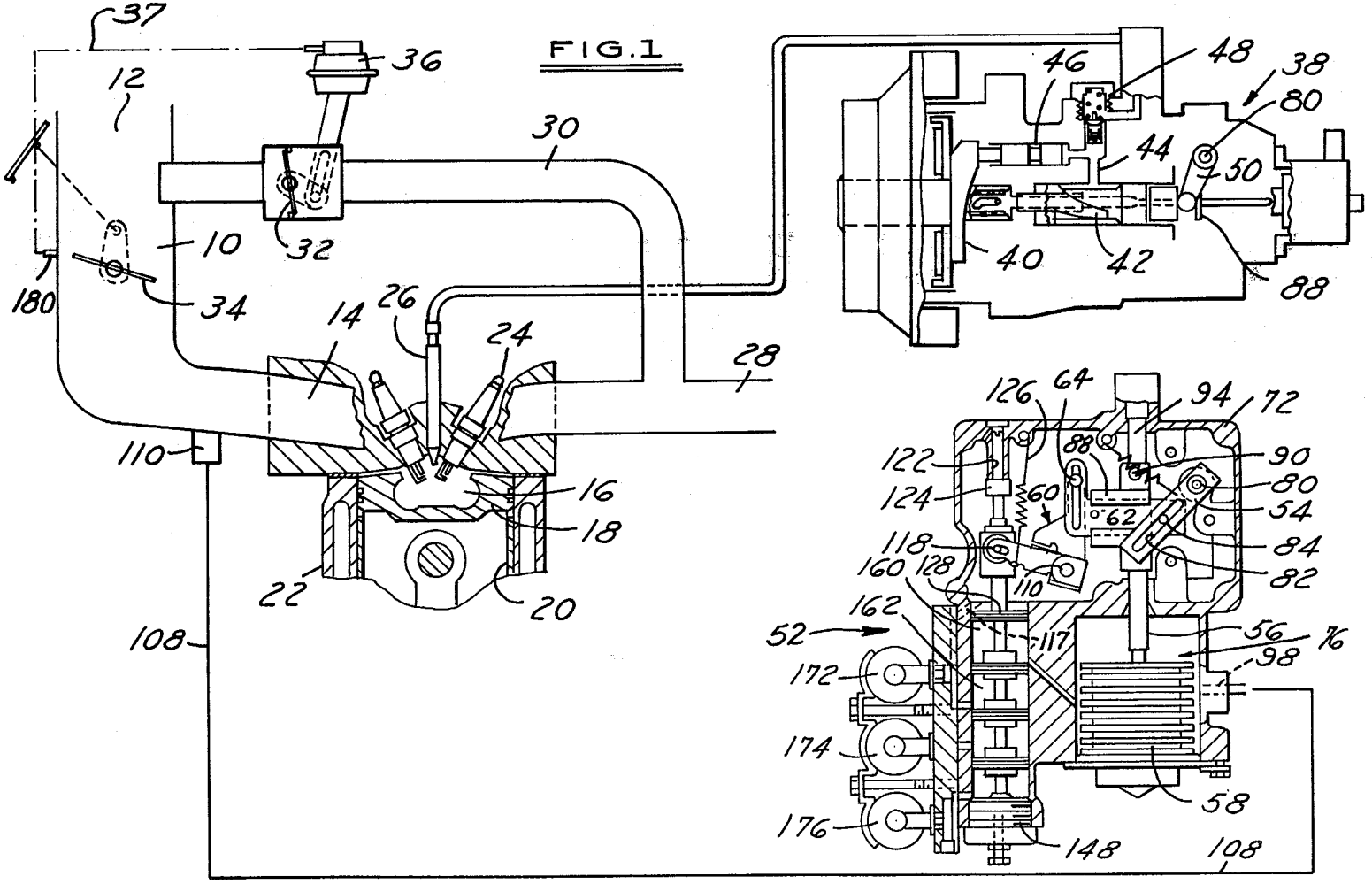

This invention relates in general to a fuel injection system for an internal combustion engine. More particularly, it relates to an air/fuel ratio regulator that is an improvement over the invention shown and described in my copending United States patent application Ser. No. 937,693, filed Aug. 29, 1978, and entitled AIR/FUEL RATIO CONTROLLER.

Ser. No. 937,693 shows and describes and air/fuel ratio controller that operates in conjunction with a fuel injection pump having a fuel output that varies in direct proportion to engine speed changes to match fuel flow with engine mass air flow characteristics over the entire engine speed and load conditions of operation. The controller has a main air/fuel ratio regulator consisting of a vacuum aneroid responsive to changes in intake manifold vacuum level to move the injection pump fuel control lever to a position to maintain a constant air/fuel mixture change ratio at all times. A fuel enrichment control lever is provided to modify the actions of the aneroid to compensate for changes in the oxygen content in the mixture due to the addition of, for example, exhaust gases that are recirculated back into the manifold, and/or changes in the intake gas temperature. A manual override of the fuel enrichment lever after it has reached the zero EGR flow position will also modify the air/fuel ratio of maximum fuel enrichment at essentially wide open throttle conditions of operation of the engine. However, the latter override is the only variance from a constant air/fuel ratio regulation of the fuel pump provided by the controller of Ser. No. 937,693.

This invention is directed to an air/fuel ratio regulator that maintains a constant air/fuel ratio as in Ser. No. 937,693 by means of a manifold vacuum responsive aneroid mechanism. It also includes a fuel enrichment control lever. However, in this invention, the enrichment lever is movable to various positions to establish different air/fuel ratios to the mixture charge. In other words, this invention is directed to an air/fuel ratio regulator that permits the establishment of an infinite number of different air/fuel ratio settings to satisfy different engine operating requirements, the settings again being attained by movement of the fuel injection pump flow control lever to change the fuel flow output.

Therefore, it is an object of this invention to provide a fuel injection system air/fuel ratio regulator that permits independent adjustments to establish various air/fuel ratios of the mixture charge flowing to the engine combustion chamber.

More particularly, it is an object of this invention to provide a fuel injection system air/fuel ratio regulator that establishes a base constant air/fuel ratio to the mixture charge supplied to the engine combustion chamber by moving the fuel injection pump flow control lever to increase or decrease fuel flow as a function of changes in intake manifold vacuum, and establishes further air/fuel ratios leaner and/or richer than the base air/fuel ratio to fulfill various operating conditions of the engine not satisfied by the base air/fuel ratio.

It is another object of the invention to provide a regulator of the type described above having a fuel enrichment lever that can be moved to a position providing richer air/fuel ratios than the base ratio, for maximum engine acceleration purposes; can provide leaner air/fuel ratios than the base ratio during extended periods of cruising operation of the engine, for better fuel economy; can provide different leaner air/fuel ratios than the base ratio for operating the engine at different idle speeds and decelerating conditions of operation for better emission control; and can maintain the engine at the base ratio even though the recirculation of exhaust gases is desired to control $No_x$ emissions.

It is a still further object of the invention to provide an air/fuel ratio regulator of the type described above in which the fuel enrichment lever is normally biased to a maximum enrichment position and movable in the opposite direction in response to intake manifold vacuum, the lean air/fuel ratio setting position being established by a number of adjustable fluid pressure control devices independently operable and adjustable so as to provide an infinite number of lean air/fuel ratio settings.

Figure 2:
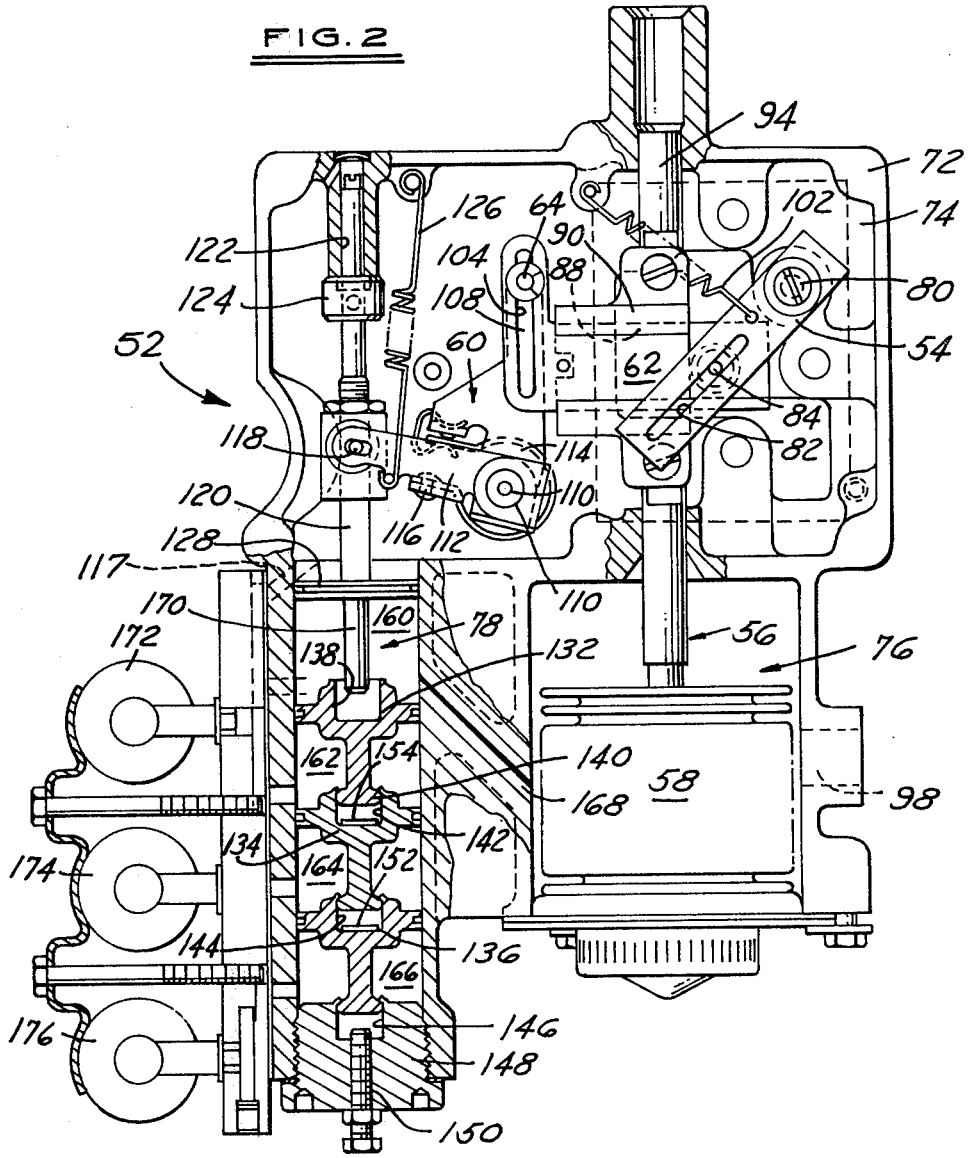

Other objects, features and advantages of the invention will become more apparent upon reference to the succeeding detailed description thereof and to the drawings illustrating the preferred embodiment thereof; wherein, FIG. 1 is a schematic illustration of an internal combustion engine fuel injection system embodying the invention; and, FIG. 2 is a cross-sectional view on an enlarged scale of the regulator shown in FIG. 1 embodying the invention.

FIG. 1 illustrates schematically a portion of the induction and exhaust system of a fuel injection type internal combustion engine in which is incorporated the air/fuel ratio regulator of this invention.

More specifically, the system includes an air-gas intake manifold induction passage 10 that is open at one end 12 to air at essentially atmospheric or ambient pressure level and is connected at its opposite end 14 to discharge through valving (not shown) into a swirl type combustion chamber indicated schematically at 16. The chamber in this case is formed in the top of a piston 18 slidably mounted in the bore 20 of a cylinder block 22. The chamber has a pair of spark plugs 24 for the ignition of the intake mixture charge from the induction passage 14 and the fuel injected from an injector 26 providing a locally rich mixture and overall lean cylinder charge. An exhaust gas conduit 28 is connected to a passage 30 that recirculates a portion of the exhaust gases past a vacuum opened, spring closed EGR valve 32 to a point near the inlet to the induction passage 10 and above the closed position of a conventional throttle valve 34. Thus, movement of the throttle valve 34 provides the total control of the mass flow of gas (air plus EGR) into the engine cylinder.

The EGR valve is rotatable by a vacuum servo mechanism 36 that is connected by a line indicated schematically at 37 to a port 180 above the closed position of the throttle valve 34. Opening of the throttle valve directs vacuum to the servomechanism to provide a flow of exhaust gases during the load conditions of operation of the engine.

The fuel in this case delivered to injector 26 is provided by a fuel injection pump 38 of the plunger type that is shown and described more fully in my application U.S. Ser. No. 937,693 referred to above. The details of construction and operation of the pump are fully described in the above U.S. Ser. No. 937,693 and, therefore, are not repeated since they are believed to be unnecessary for an understanding of the invention. Suffice it to say, however, that the pump has a cam face 40 that is contoured to match fuel pump output with the mass air flow characteristics of the engine for all engine speed and load conditions of operation so as to maintain a constant air/fuel ratio to the mixture charge flowing into the engine combustion chamber 16 at all times. The pump is shown with an axially movable fuel metering sleeve valve helix 42 that cooperates with a spill port 44 to block the same at times to thereby permit the output from the plunger 46 of the pump to build up a pressure against a delivery valve 48 to open the same and supply fuel to the injector 26. Axial movement of the helix by a fuel flow control lever 50 will vary the base fuel flow output rate by moving the helix to block or unblock a spill port 44 for a different period of time.

This invention is directed to an air/fuel ratio regulator that will establish a base mixture air/fuel ratio and maintain it constant, but can also establish a number of other mixture air/fuel ratios as satisfy specific engine operating conditions, provide better emission control, and increase fuel economy. The regulator is connected to the fuel pump lever 50 to change the fuel flow output as a function of manifold vacuum changes (air flow changes) upon opening of the throttle valve 34. The regulator also changes the fuel flow upon the addition of EGR gases to the intake charge; to compensate for the change in oxygen concentration changes the ratio to lean out the mixture for better fuel economy during extended periods of the engine operating at cruise conditions; and changes the ratio to lean the mixture for different engine idle speed and deceleration operation.

The regulator is illustrated in general in FIG. 1 at 52, and more particularly in FIG. 2. In general, it contains a vacuum-mechanical linkage mechanism that includes an arcuately movable fuel control lever 54 that is connected to the fuel injection pump fuel lever 50 (FIG. 1). It also contains a fuel flow output control rod 56 that is connected to an aneroid 58 to be responsive to intake manifold vacuum changes, and a fuel enrichment linkage or fuel ratio changing linkage 60. Linkage 60 is connected to the rod 56 and lever 54 by a cross slide 62 and floating roller 64 and moves in response to the flow of EGR gases and the attainment of other engine operating conditions to be described to establish other A/F ratios.

More specifically, the regulator 52 has a shell-like housing 72 defining a main chamber 74, a barometric pressure responsive chamber 76, and a chamber 78 containing a number of servo mechanisms for controlling the establishment of air/fuel ratios to the mixture charge that are different from the base A/F ratio. The housing 72 contains a number of mounting lugs or bosses on one of which is pivotally mounted a control shaft 80 on which is fixed the fuel lever 54 and fuel pump fuel lever 50 (FIG. 1) 50 (FIG. 1) 54, therefore, is operatively pivotally connected to the fuel injection pump metering sleeve valve helix 42 shown in FIG. 1 so that counterclockwise movement of lever 54 will cause a movement of the pump helix to increase the fuel flow output or rate of flow. A spring 102 anchored to the housing normally biases the fuel control lever in a clockwise direction to a minimum or base fuel flow position of the fuel metering sleeve valve helix 42 shown in FIG. 1.

The lever 54 is formed with an elongated cam slot 82 through which projects a roller 84 that is mounted in cross slide member 62. The cross slide is mounted for a sliding movement within a channel 88 formed in a cross slide guide 90 adjustably connected and mounted on the movable rod 56. The rod or shaft 56 has one end 94 slidably mounted in the housing 72 with its other end projecting through the housing into chamber 76 for attachment to the end of a bellows type metallic aneroid 58. The aneroid 58 is sealed with vacuum inside and subjected to intake manifold absolute pressure (vacuum) admitted to chamber 76 through an inlet 98 connected to tubing indicated schematically by the line 108 shown in FIG. 1. The changes in manifold vacuum level cause an expansion or contraction of the aneroid to move the shaft 56 vertically causing roller 84 to pivot the fuel control lever 54.

The cross slide 62 has formed on its left end as seen in FIG. 2 an elongated cam slot 104 within which moves the floating roller 64. The roller is pivotally attached to one leg of the fuel enrichment control bellcrank lever 60 pivotally mounted at 110 to the housing 72 and having a right angled leg portion 112 fixed to the pivot shaft. The two leg portions of the bellcrank can move relative to one another but normally move together. Let 108 is pivotally connected to leg 112 and normally clamped together by a thermostatically responsive coil spring member 114 anchored to the leg 112 at 116 and anchored at its opposite end to the leg 108. The cavity 74 in which lever 60 is located is exposed to the temperature of the intake manifold gas flow through a passage 117. When the temperature level varies from the setting of the coiled spring, its thermal expansion causes a movement of the leg 108, and roller 106 relative to the leg 112 to adjust the position of the cross slide 62 and thereby adjust the position of fuel control lever 54 and pump lever 50 to change the fuel flow and maintain a constant base air/fuel ratio by compensating for the changes in density of the gas.

The leg 112 of the fuel enrichment control lever 60 is connected by a pin and slot type adjustable connection 118 to a fuel enrichment control rod 120. Rod 120 at one end is piloted in a bore 122 in the housing 72 and has an adjustable stop 124 for fixing the maximum fuel delivery position of the enrichment control lever 60. A spring 126 normally biases the lever 60 against the stop 124 to the maximum engine acceleration position providing the largest rate of fuel flow.

The opposite end of enrichment rod 120 is formed with an enrichment piston 128 slidably movable in the constant diameter bore of chamber 78. Also slidably mounted in the bore are three additional axially aligned and movable pistons 132, 134, and 136. The latter pistons are T-shaped in cross-section as shown and nested or interconnected with each other for a limited relative movement between contiguous piston portions. That is, the end of enrichment rod 120 cooperates with a recess 138 in piston 132, the stem end 140 of piston 132 is slidably mounted within a recess 142 in piston 134, the stem end of piston 134 is slidably mounted within a recess 144 in piston 136, and the stem end of piston 136 is slidably mounted within a recess 146 in the end plate 148 that is screwed into the open end of the bore in housing 72. A further adjustable screw 150 is provided projecting into the bore 146 to vary the relative expansion between the end cap and piston 136. A pair of shims 152,154 of varying thicknesses may also be provided in the recesses 144 and 142 to control the amount of backlash or extension of the parts.

As noted previously, the diameters of all of the pistons is the same. Vacuum admitted to any of the chambers causes a collapse movement of the two adjacent piston portions towards one another while atmospheric pressure in the chamber acts to separate the two to define the maximum backlash. Each of the pistons 134 and 136 and the end cap 148 is peened over the stem of the contiguous piston to limit the expansion.

The multi-piston construction just described constitutes a variable stop mechanism to predetermine the position of the enrichment rod 120 and fuel enrichment lever 60 under various operating conditions of the engine. For example, the enrichment chamber 160 is connected to manifold vacuum in chamber 76 by a passage 168, and will be moved downwardly against the force of spring 126 to a leaner fuel flow position only during moderate and high manifold vacuum conditions. Under high and moderate vacuum conditions, indicative of low and moderate load conditions, the enrichment piston 128 and piston 132 also are pulled towards one another, the stem 170 of piston 128 seating against the bottom wall of the recess 138 of piston 132. The extent of upward movement of piston 132 will be determined by the position of its stem relative to piston 142, and whether air or vacuum is in chamber 162. As the manifold vacuum decreases upon opening the throttle valve for maximum engine acceleration, the vacuum, decaying to a low level will cause a return movement of the enrichment piston 128 away from the piston 132 by virtue of the force of spring 126. As stated, the piston 132 being interconnected to piston 134 in turn connected to piston 136 locked to end plate 146 will determine the stop position of the enrichment rod 120 in the opposite direction.

Solenoid controlled three-way valves illustrated schematically at 172, 174, and 176 selectively control the admission of a reservoir or other vacuum such as manifold or ported vacuum, for example, or atmospheric pressure to each of the chambers 162, 164, and 166, depending upon the operating condition of the engine. For example, chamber 162 in this case is designated the exhaust gas recirculating controlling chamber, chamber 164 controls the air/fuel ratio setting for cruise lean out condition of operation of the vehicle, and chamber 166 controls the air/fuel ratio setting of engine idle speed and deceleration conditions of operation.

More specifically, the throttle valve 34 shown in FIG. 1 is interconnected with the EGR valve 32 to provide a defined schedule of flow of exhaust gases as a function of the load upon opening of the throttle valve. As stated previously, the EGR valve in this case may be controlled in a known manner by an intake manifold ported vacuum signal from a port 38 (FIG. 1) located above the closed position of the throttle valve. An engine idle speed operation, no EGR flow will occur because the port 38 is connected to atmosphere. At wide open throttle conditions of engine operation, the intake manifold vacuum is zero and again the EGR valve will close because of lack of vacuum actuation. In between the two extremes, the EGR valve will open as a function of the load as indicated by the position of the throttle valve to substitute exhaust gases for a portion of the air in the mass flow into the engine. This decrease in oxygen concentration calls for a decrease in fuel flow output from the pump in order to maintain a constant air/fuel ratio.

Referring again to FIG. 2, prior to opening the throttle valve, high manifold vacuum in chamber 160 has pulled piston 128 down to seat stem 170 in the recess 138 of piston 132. Atmospheric air in chamber 162 has forced pistons 132 and 134 apart so that the stopped position of piston 128 and stem 170 is fixed, Now, when the EGR valve opens, upon moderately opening the throttle value, a control not shown will energize the solenoid 172 to open its valve to admit vacuum to chamber 162. This collapses the two pistons 132 and 134 against the spacer or shim 154. Therefore, under moderate vacuum conditions (moderate load) manifold vacuum present in chamber 160 moves enrichment piston 128 further down with piston 132 until the stem of piston 132 seats against the shim 154, which will determine the fuel flow setting desired during EGR flow to maintain the constant A/F ratio. This further downward movement also moves the enrichment lever 60 to a leaner position, causing a horizontal movement of the slide 86 to pivot the fuel control lever 54 and change the fuel pump fuel outlet rate. When the throttle value is a again closed for idle speed conditions of operation, the EGR valve will also close because the pressure in port 37 is, now atmospheric, and the solenoid 176 will be deenergized to again admit atmospheric air to chamber 162. This will separate the pistons 132 and 134 and thus let the enrichment rod 120, move up to the richer fuel flow setting position. It may be desired to also provide for a change in the idle speed to compensate for differences observed between different fuel injection pumps. A leaner than base A/F ratio can be obtained by triggering the solenoid 176 to move its valve to admit vacuum to the chamber 166 to collapse the piston 136 into the recess of end cap 148, thus moving the entire piston assembly to a leaner air/fuel ratio position under the influence of high or moderate manifold vacuum on piston 128. In off idle operation, atmospheric air added to idle speed chamber 166 will again extend the piston 136 from the end cap 148 to predetermine the conventional or base idle stopped position of the enrichment rod 120.

Finally, during cruising operation of the vehicle for extended periods of time, for fuel economy reasons, a leaner air/fuel ratio is desirable. This is accomplished by energizing the solenoid 174 to open its valve to reservoir vacuum when the vehicle has reached third speed operation, for example, and the temperature level is above a certain value. Vacuum then admitted to chamber 164 will collapse the piston 134 into piston 136. The manifold vacuum in chamber 160 will then pull the piston 128 against the piston 132 and the piston 132 against the piston 134 to a lean air/fuel mixture ratio position suitable for cruising. Downshift of the transmission will deenergize the solenoid 174 to cause atmospheric air to be admitted to the chamber 164 to again extend piston 134 from piston 136 and move the enrichment piston 128 to a richer air/fuel mixture ratio position.

The supply of vacuum to the solenoid valves 172, 174, and 176 may be as desired such as from a reservoir, as stated, supplied by a vacuum pump. Ported manifold vacuum in this case can be supplied to the EGR chamber 162 so as to provide a control consistent with the movement of the EGR valve in response to opening of the throttle valve.

It will be seen that the stopped position of the enrichment piston 128 will depend upon a number of conditions such as whether EGR is occurring, whether the vehicle is operating in a cruise condition, or whether it is operating at idle speed or deceleration conditions of operation. It will also be seen that the stopped positions are adjustable by the use of spacers or shims 152,154 in the recesses of selected pistons, and that the base air/fuel ratio initially can be changed by movement of the adjustable connection 118 of the fuel enrichment lever 60 to fuel enrichment rod 120.

As stated initially, this invention is directed towards an air/fuel ratio regulator that first will control the output of a fuel injection pump in response to engine manifold vacuum changes to maintain a constant air/fuel ratio to the mixture charge entering the engine at all times regardless of variations in intake gas temperature and manifold pressure. Secondly, the regulator permits a change in the fuel flow to correspond to certain particular conditions of operation of the engine such as during flow of exhaust gases, a leaning out operation during cruising at extended periods, and a leaner operation for engine idle speed and deceleration.

The operation of the invention is believed to be clear from the above description and, therefore, will not be repeated in detail. Suffice it to say that changes in intake manifold vacuum upon opening of the throttle valve cause the aneroid 58 to move the control rod 56 to move the roller 84 and pivot the fuel control lever 54 to change fuel flow from the pump to match the change in air flow to maintain a constant air/fuel ratio. Simultaneously, the change in intake manifold gas temperature reflected by the position of the coil spring 114 causes a pivotal movement of the leg 108 of fuel enrichment lever 60 causing a movement of the cross slide 86 at right angles to the direction of movement of the aneroid rod 56 to again pivotally move the fuel lever 54, to compensate or correct the fuel flow to again maintain the constant air/fuel ratio.

This constant air/fuel ratio condition will prevail over most of the operating conditions of the engine i.e., the moderate and high vacuum conditions indicative of moderate or no loads. However, a different idle speed or deceleration air/fuel ratio may be desired to provide a leaner operation. In this case, high manifold vacuum (low absolute pressure) acting in piston chamber 160 will as usual move the enrichment piston 128 against the piston 132. At this time, atmospheric pressure is in chambers 162 and 164 moving pistons 132 and 134 away from each other and piston 136. If now reservoir vacuum is admitted to chamber 166 piston 136 is pulled against the end plate 148 causing the enrichment piston 128 to assume a position that will establish an idle lean air/fuel ratio of approximately 19:1, for example. This pivots the fuel enrichment lever 60 counterclockwise to move the cross slide 86 leftwardly as seen in FIG. 2 and pivot the fuel lever 54 clockwise to decrease the fuel pump output flow to correspond to the 19:1 A/F ratio called for.

During extending cruising operation, again a leaner A/F ratio may be desired. In this case chamber 166 can be vented to atmospheric pressure and vacuum admitted to chambers 162 and 164 to collapse pistons 132 and 134 and 136 together so that manifold vacuum pulling the piston 128 against the piston 132 will establish a lean air/fuel cruising mixture ratio of approximately 20:1, again established by movement of the fuel enrichment lever 60, cross slide 86, and fuel lever 54.

During the flow of EGR gases, the ported vacuum used to actuate the EGR vacuum servo 36 may be introduced to chamber 162, with chambers 164 and 166 vented to atmosphere thereby expanding the chambers and causing a new stop position for the enrichment piston 128 to establish a 20:1 A/F ratio, for example if de- sired. While in this condition, full depression of the vehicle accelerator pedal and opening wide of the throttle valve for maximum acceleration will cause a gradual transition from full EGR to no EGR as the ported manifold vacuum decreases in servo 36 and chamber 162 towards zero, and also the manifold vacuum in chamber 160, allowing the enrichment spring 126 to gradually move the enrichment rod 120 and enrichment lever 60 to the maximum fuel enrichment positions moving the fuel lever 54 counterclockwise to the fuel pump maximum fuel delivery position.

From the foregoing, it will be seen that the invention provides a regulator that establishes a base air/fuel ratio and maintains that ratio constant over the normal operating range of the engine, and that it also provides means for establishing various other air/fuel ratios as a function of different operating conditions of the engine to meet engine requirements, and that it also provides for an infinite number of adjustments of the air/fuel ratio establishing mechanism to provide very fine tuning of the engine control system and a maximum versatility of the regulator.

While the invention has been shown and described in its preferred embodiment, it will be clear to those skilled in the arts to which it pertains that many changes and modifications may be made thereto without departing from the scope of the invention.

I claim:

1. An air/fuel ratio regulator for use with the fuel injection control system of an internal combustion engine of the spark ignition type having an air and exhaust gas (gas) induction passage open at one end to air at ambient pressure level and connected at its other end to the engine combustion chamber to be subject to manifold vacuum changes therein, a throttle valve rotatably mounted for movement across the passage to control the gas flow therethrough, exhaust gas recirculation (EGR) passage means connecting engine exhaust gases to the induction passage above the closed position of the throttle valve, an EGR flow control valve mounted in the EGR passage means for movement between open and closed positions to control the volume of EGR gas flow, an engine speed responsive positive displacement type fuel injection pump having a fuel flow output to the engine that varies in direct proportion to changes in engine speed to match fuel flow and mass air flow through the induction system of the engine over the entire speed and load range of the engine to maintain the intake mixture ratio of air to fuel constant, the pump having a fuel flow control lever movable to vary the fuel rate of flow, the regulator being characterized by engine manifold vacuum responsive first servo means operably connected to the fuel control lever for maintaining a constant air/fuel (A/F) ratio by changing fuel flow output as a function of changing manifold vacuum and air flow upon opening of the throttle valve, a fuel enrichment control lever operably connected to the pump control lever and movable to modify the position of the pump lever dictated by the first servo means to change the A/F ratio, and further means responsive to engine operating conditions for moving the fuel enrichment control lever to provide the changed A/F ratio, the further means including a second manifold vacuum responsive servo means for moving the enrichment lever in a fuel flow decreasing direction, spring means biasing the enrichment lever in a fuel flow increasing direction for maximum enrichment and richest A/F ratio upon decay of manifold vacuum during maximum engine acceleration, and variably adjustable stop means in the path of movement of the enrichment lever in a fuel flow decreasing, leaning A/F ratio direction to vary the A/F ratio upon adjustment of the stop means, the variable stop means including a plurality of inline interconnected fluid actuated pistons relatively movable with respect to each other for varying the linear distance between pistons.

2. An air/fuel ratio regulator for use with the fuel injection control system of an internal combustion engine of the spark ignition type having an air and exhaust gas (gas) induction passage open at one end to air at ambient pressure level and connected at its other end to the engine combustion chamber to be subject to manifold vacuum changes therein, a throttle valve rotatably mounted for movement across the passage to control the gas flow therethrough, exhaust gas recirculation (EGR) passage means connecting engine exhaust gases to the induction passage above the closed position of the throttle valve, an EGR flow control valve mounted in the EGR passage means for movement between open and closed positions to control the volume of EGR gas flow, an engine speed responsive positive displacement type fuel injection pump having a fuel flow output to the engine that varies in direct proportion to changes in engine speed to match fuel flow and mass air flow through the induction system of the engine over the entire speed and load range of the engine to maintain the intake mixture ratio of air to fuel constant, the pump having a fuel flow control lever movable to vary the fuel rate of flow, the regulator being characterized by engine manifold vacuum responsive first servo means operably connected to the fuel control lever for maintaining a constant air/fuel (A/F) ratio by changing fuel flow output as a function of changing manifold vacuum and air flow upon opening of the throttle valve, a fuel enrichment control lever operably connected to the pump control lever and movable to modify the position of the pump lever dictated by the first servo means to change the A/F ratio, and further means responsive to engine operating conditions for moving the fuel enrichment control lever to provide the changed A/F ratio, the further means including a second manifold vacuum responsive servo means for moving the enrichment lever in a fuel flow decreasing direction, spring means biasing the enrichment lever in a fuel flow increasing direction for maximum enrichment and richest A/F ratio upon decay of manifold vacuum during maximum engine acceleration, and variable adjustable stop means in the path of movement of the enrichment lever in a fuel flow decreasing, leaning A/F ratio direction to vary the A/F ratio upon adjustment of the stop means, the variable stop means including a fluid pressure actuated piston having a set stop position and variably movable from that position to a leaner A/F ratio stop position in response to opening of the EGR valve.

3. An air/fuel ratio regulator for use with the fuel injection control system of an internal combustion engine of the spark ignition type having an air and exhaust gas (gas) induction passage open at one end to air at ambient pressure level and connected at its other end to the engine combustion chamber to be subject to manifold vacuum changes therein, a throttle valve rotatably mounted for movement across the passage to control the gas flow therethrough, exhaust gas recirculation (EGR) passage means connecting engine exhaust gases to the induction passage above the closed position of the throttle valve, an EGR flow control valve mounted in the EGR passage means for movement between open and closed positions to control the volume of EGR gas flow, an engine speed responsive positive displacement type fuel injection pump having a fuel flow output to the engine that varies in direct proportion to changes in engine speed to match fuel flow and mass air flow through the induction system of the engine over the entire speed and load range of the engine to maintain the intake mixture ratio of air to fuel constant, the pump having a fuel flow control lever movable to vary the fuel rate of flow, the regulator being characterized by engine manifold vacuum responsive first servo means operably connected to the fuel control lever for maintaining a constant air/fuel (A/F) ratio by changing fuel flow output as a function of changing manifold vacuum and air flow upon opening of the throttle valve, a fuel enrichment control lever operably connected to the pump control lever and movable to modify the position of the pump lever dictated by the first servo means to change the A/F ratio, and further means responsive to engine operating conditions for moving the fuel enrichment control lever to provide the changed A/F ratio, the further means including a second manifold vacuum responsive servo means for moving the enrichment lever in a fuel flow decreasing direction, spring means biasing the enrichment lever in a fuel flow increasing direction for maximum enrichment and richest A/F ratio upon decay of manifold vacuum during maximum engine acceleration, and variable adjustable stop means in the path of movement of the enrichment lever in a fuel flow decreasing, leaning A/F ratio direction to vary the A/F ratio upon adjustment of the stop means, the variable stop means including a fluid pressure actuated piston variable movable from a set stop position in response to the attainment of engine idle speed and deceleration conditions of operation of the engine to a leaner A/F ratio set stop position.

4. An air/fuel ratio regulator for use with the fuel injection control system of an internal combustion combustion engine of the spark ignition type having an air and exhaust gas (gas) induction passage open at one end to air at ambient pressure level and connected at its other end to the engine combustion chamber to be subject to manifold vacuum changes therein, a throttle valve rotatably mounted for movement across the passage to control the gas flow therethrough, exhaust gas recirculation (EGR) passage means connecting engine exhaust gases to the induction passage above the closed position of the throttle valve, an EGR flow control valve mounted in the EGR passage means for movement between open and closed positions to control the volume of EGR gas flow, an engine speed responsive positive displacement type fuel injection pump having a fuel flow output to the engine that varies in direct proportion to changes in engine speed to match fuel flow and mass air flow through the induction system of the engine over the entire speed and load range of the engine to maintain the intake mixture ratio of air to fuel constant, the pump having a fuel flow control lever movable to vary the fuel rate of flow, the regulator being characterized by engine manifold vacuum responsive first servo means operably connected to the fuel control lever for maintaining a constant air/fuel (A/F) ratio by changing fuel flow output as a function of changing manifold vacuum and air flow upon opening of the throttle valve, a fuel enrichment control lever operably connected to the pump control lever and movable to modify the position of the pump lever dictated by the first servo means to change the A/F ratio, and further means responsive to engine operating conditions for moving the fuel enrichment control lever to provide the changed A/F ratio, the further means including a second manifold vacuum responsive servo means for moving the enrichment lever in a fuel flow decreasing direction, spring means biasing the enrichment lever in a fuel flow increasing direction for maximum enrichment and richest A/F ratio upon decay of manifold vacuum during maximum engine acceleration, and variably adjustable stop means in the path of movement of the enrichment lever in a fuel flow decreasing, leaning A/F ratio direction to vary the A/F ratio upon adjustment of the stop means, the stop means including a plurality of axially aligned internested pistons having a limitation relative movement therebetween providing a range of adjustment of the A/F ratio.

5. An air/fuel ratio regulator for use with the fuel injection control system of an internal combustion engine of the spark ignition type having an air and exhaust gas (gas) induction passage open at one end to air at ambient pressure level and connected at its other end to the engine combustion chamber to be subject to manifold vacuum changes therein, a throttle valve rotatably mounted for movement across the passage to control the gas flow therethrough, exhaust gas recirculation (EGR) passage means connecting engine exhaust gases to the induction passage above the closed position of the throttle valve, an EGR flow control valve mounted in the EGR passage and movable between closed and open positions in response to opening and closing of the throttle valve to control the volume of EGR gas flow, an engine speed responsive positive displacement type fuel injection pump having a fuel flow control lever and fuel flow output to the engine that varies in direct proportion to changes in engine speed to match fuel flow and mass air flow through the induction system of the engine over the entire speed and load range of the engine to maintain the air/fuel (A/F) ratio of the intake mixture constant, the regulator being characterized by a fluid chamber connected to engine intake manifold vacuum and containing a vacuum filled aneroid, means operably connecting the aneroid to the fuel control lever for varying fuel output as a function of changes in engine manifold vacuum to maintain a constant A/F ratio, a fuel enrichment control lever also operably connected to the pump fuel control lever for modifying the position of the pump lever to change the A/F ratio from the constant value, spring means biasing the fuel enrichment control lever towards a position moving the pump lever to an A/F ratio setting richer than the constant A/F ratio setting, a manifold vacuum responsive piston connected to the enrichment lever and responsive to increases in vacuum in the fluid chamber for variably moving the enrichment lever towards a position providing an A/F ratio that is equal to or leaner than the constant A/F ratio, and adjustable stop means in the path of movement of the piston responsive to predetermined engine operating conditions to adjust the position of the stop means to thereby vary and predetermine the A/F ratio, a bore slidably containing the piston, the adjustable stop means including first and second and third piston means all axially aligned in the bore with the piston to define first and second and third fluid pressure chambers therebetween, each piston means having a lost motion connection to the contiguous piston means providing limited axial relative movement therebetween to thereby provide an infinite number of adjusted positions and of all of the piston means relative to the piston, thereby providing an infinite number of different A/F ratios, and control means for directing vacuum to the first chamber in response to EGR flow to axially pull the first piston means against the second piston means and in a direction away from the piston to determine the stopped lean A/F ratio position of the piston upon increase in manifold vacuum above a predetermined level.

6. A regulator as in claim 5, including second control means responsive to the attainment of an engine cruising condition of operation for an extended period for supplying vacuum to the second chamber to move the second and third piston means together and in a leaner A/F ratio direction.

7. A regulator as in claim 6, including third vacuum control means for supplying vacuum to the third chamber to move the third piston means in a leaner A/F direction to provide a different idle speed and decelerating condition of operation A/F ratio.

* * * * *